United States Patent [19]

Turner

[11] 4,251,888

[45] Feb. 24, 1981

[54] VENTILATING TOILET SEAT

[76] Inventor: William F. Turner, Box 156, Blandburg, Pa. 16619

[21] Appl. No.: 31,824

[22] Filed: Apr. 20, 1979

[51] Int. Cl.[3] ..... E03D 9/052; A47K 13/24

[52] U.S. Cl. ..... 4/213; 4/217

[58] Field of Search ..... 4/213, 217, 347, 348, 4/350, 352, 209 R, 210, 211, 218, 219

[56] References Cited

U.S. PATENT DOCUMENTS

| | | | |
|---|---|---|---|
| 2,172,506 | 9/1939 | Gerger | 4/217 |
| 3,333,285 | 8/1967 | Null | 4/217 |
| 3,763,505 | 10/1973 | Zimmerman | 4/213 |
| 3,999,225 | 12/1976 | Ables | 4/217 X |
| 4,125,906 | 11/1978 | Weiland | 4/217 |

*Primary Examiner*—Stuart S. Levy

*Attorney, Agent, or Firm*—Thomas E. Sterling

[57] ABSTRACT

The toilet seat of this invention has a hollow central portion therein with holes in the front and rear of the inner lateral sides through which air is drawn inwardly. Vacuum hoses are connected to the hollow central portion of the toilet seat and lead to a vacuum pump mounted near the toilet. The vacuum pump sucks the odor-laden air from the toilet seat area and blows it to the outside through an expulsion tube.

3 Claims, 6 Drawing Figures

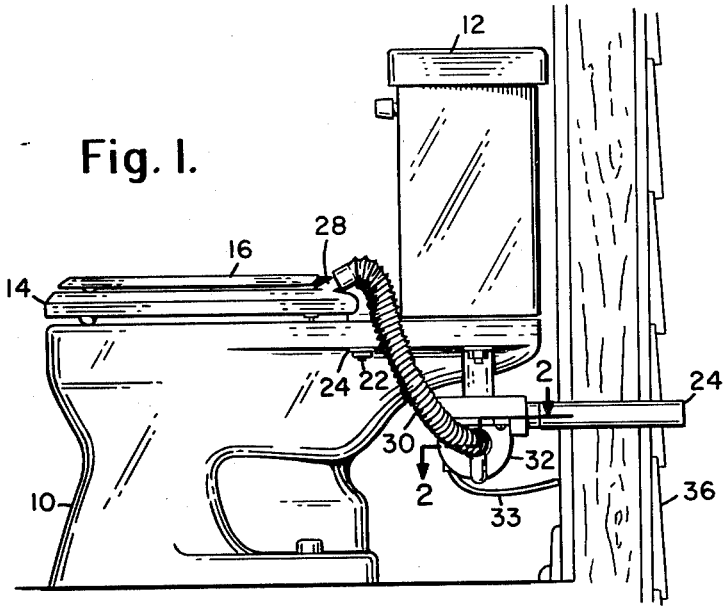
Fig. 1.
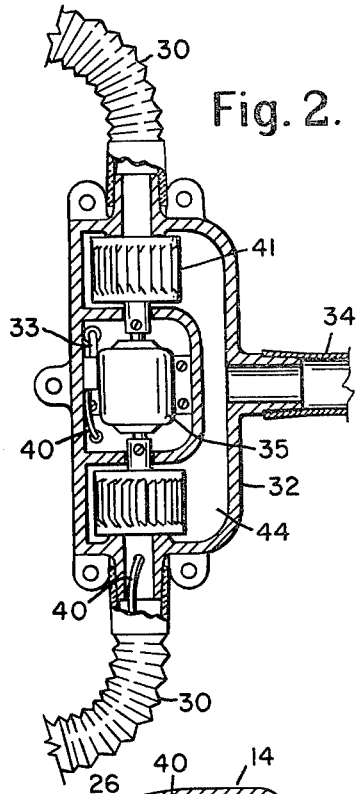
Fig. 2.
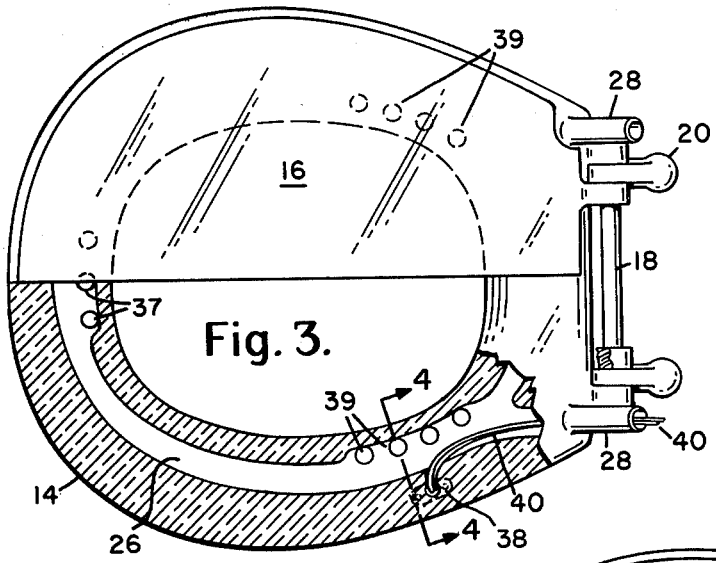
Fig. 3.
Fig. 4.
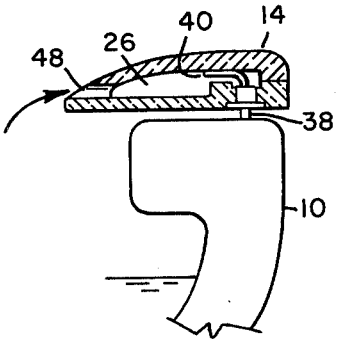
Fig. 6.
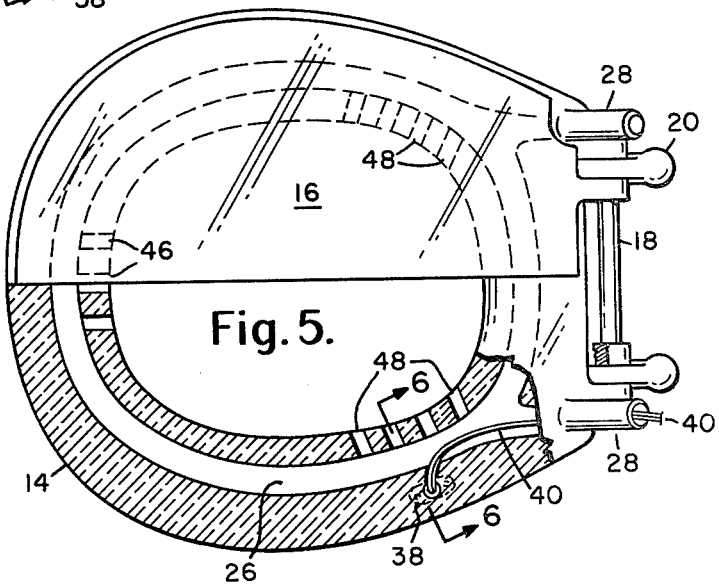
Fig. 5.

VENTILATING TOILET SEAT

PRIOR ART STATEMENT

The inventor knows of no prior art anticipating this invention and is not withholding any prior art.

This invention relates to toilet seats and, in particular, to toilet seats having a ventilating mechanism adapted to remove noxious odors from the bathroom.

Bathrooms are frequently prone to having noxious odors. The use of the conventional toilet lends itself to odors of feces and urine being circulated throughout the bathroom. This is true even though the conventional toilet has water therein into which liquid and solid wastes are deposited. If the bathroom does not have an adequate ventilating system, these odors remain in the room and are often distributed to adjacent rooms when the bathroom door is open.

Most of these odors originate in the bowl of the conventional water toilet or water closet into which liquid and solid wastes are deposited and are later flushed away by water stored in a water storage tank.

This invention relates to a toilet seat having suction means therein and, in particular, a toilet seat adapted to draw noxious odors from the toilet bowl and expel them to the outside. In this way, the noxious odors are withdrawn from the bathroom at their source, the toilet bowl. The odors never have an opportunity to circulate into and throughout the bathroom.

This toilet seat of this invention has a hollow central portion therein with holes in the front and rear through which air is drawn inwardly. Vacuum hoses are connected to the hollow central portion of the toilet seat and lead to a vacuum pump mounted near the toilet. The vacuum pump is connected to an expulsion tube which blows the odor-laden air to the outside.

The vacuum pump of this toilet seat is activated by a pressure time switch located in the bottom portion of the seat. The switch operates when the toilet seat is pressed down or sat upon. Thus, when the toilet seat is sat on, as in use, the vacuum system is turned on, drawing air from the toilet bowl into the hollow toilet seat and expelling it through the vacuum system from the bathroom. When the user rises from the toilet seat, the seat is pressed upward by the switch. The switch, however, remains in the "on" position for about sixty seconds after it is released to remove the last vestige of odor from the toilet bowl. The vacuum toilet seat is designed to replace conventional toilet seats and may be installed upon almost any conventional toilet.

An object of this invention, therefore, is to provide a toilet seat capable of sucking noxious odors from the toilet bowl and expelling them from the bathroom.

Another object of this invention is to provide a vacuum producing system connected with a ventilating toilet seat capable of drawing odor-laden air from the toilet.

Still another object of this invention is to provide a ventilating toilet seat having ventilating holes in the front and rear portions thereof for the removal of noxious odors from the toilet.

Yet another object of this invention is to provide a concealable vacuum system connected to a ventilating toilet seat.

Yet another object of this invention is to provide a simple, inexpensive method of ventilating a conventional toilet.

Still another object of this invention is to provide a ventilating toilet seat without obvious wires or connections.

Another object of this invention is to provide a toilet seat that will conserve water because additional flushings are not necessary to get rid of toilet odors.

Still another object of this invention is to provide a toilet ventilating device which is activated when it is sat upon and deactivated when released.

These and other objects of this invention will become clear upon the examination of the foregoing specifications and claims in conjunction with the drawings in which:

FIG. 1 is a side view of a conventional water flushing toilet with the ventilating toilet seat of the present invention installed thereon;

FIG. 2 is a view of the vacuum pump of the invention, partially in section, taken along line 2—2 of FIG. 1;

FIG. 3 is a top view of the ventilating toilet seat of FIG. 1, a portion of which is sectioned through the mid-line;

FIG. 4 is a cross-sectional view taken along line 4—4 of FIG. 3.

FIG. 5 is a top view of a modification of the toilet seat, partially in section;

FIG. 6 is a cross-sectional view taken along lines 6—6 of FIG. 1.

Referring to the drawings and, in particular, to FIGS. 1 and 3, 10 represents a conventional toilet bowl upon which rests a conventional water flushing tank 12. A ventilating toilet seat 14 rests on the top of toilet bowl 10. Toilet seat cover 16 rests on top of toilet seat 14. Both toilet seat 14 and cover 16 are hinged upon pivot bar 18 positioned in the rear of toilet bowl 10. Pivot bar 18 is attached to two mounts 20 which are bolted to toilet bowl 10 by bolts 22 secured by nuts 24. As may be seen, both toilet seat 14 and toilet seat cover 16 may be pivoted about pivot bar 18 and moved to an upward position.

Referring now to FIGS. 3 and 4, ventilating toilet seat 14 has an interior oval passage 26 extending therearound the interior portion. The rear portion of interior passage 26 is connected to two vacuum ducts 28 in the rear portion of the toilet seat 14. These ducts 28 extend upwardly and outwardly from the toilet seat 14.

The forward bottom portion of interior passage 26 has three downwardly disposed front vacuum holes 37 there-through leading to the interior of the toilet bowl 10. The rearward bottom portion of interior passage 26 has two pairs of four vacuum holes 39 positioned on each lateral portion of the seat. The vacuum holes 39 are downwardly disposed leading from interior passage 26 to the interior of the toilet bowl 10. These vacuum holes, 37 and 39, are positioned to withdraw odor-laden air from the toilet bowl areas in which urine and feces are deposited.

A time switch 38 is attached to the rear bottom portion of the toilet seat 14, in contact with the upper portion of toilet bowl 10. Time switch 38 is so designed that in its "off" position it will support toilet seat 14, causing it to pivot upwardly from the toilet bowl 10. The time switch 38 is designed to be depressed with about fifteen (15) pounds pressure after which it is in the "on" or contact position. After the switch 38 has been released, it will remain in the "on" position for about sixty (60) seconds, after which it will turn itself off. Time switch 38 is of a waterproof construction so that moisture from the toilet bowl will not corrode the switch mechanism. Time switch 38 is electrically connected by wires 40 to the vacuum producing device 32. Wires 40 extend through one of the vacuum ducts 28 and flexible hoses 30 to the vacuum producing device 32 and are thus concealed.

Referring now to FIGS. 1 and 2, two vacuum ducts 28 are connected to two flexible hoses 30 which lead to a vacuum producing device 32 attached to the bottom of toilet bowl 10. Vacuum producing device 32 may also be installed on the floor outside of the bathroom or in other positions within 5–10 feet of the toilet seat 14. Vacuum producing device 32 is comprised of a centrally positioned electric motor 35 within vacuum producing device 32, laterally connected to two cylindrical rotating vanes 41. A power wire 33 leads to the electric motor 35 from a source of house current (not shown). Operation of the motor causes the vanes 41 to rotate producing a vacuum in flexible hoses 30 and in the interior passage 26. An exhaust tube 34 is connected to exhaust chamber 44 and leads through a wall 36 to the outside. The odor-laden air is thus blown by rotating vanes 41 through exhaust tube 34. The device will also operate with a single vacuum duct 28 and a single flexible tube 30.

Referring now to FIGS. 5 and 6, there is shown a modification of the ventilating toilet seat invention which is identical to the device previously described, with the exception of the direction of the three front holes 37 and the pair of four rear holes 39. In this modification, four front vacuum holes 46 extend horizontally from interior passage 26 to the interior of toilet bowl 10. A pair of four rear vacuum holes 48 are laterally positioned on either side of seat 14 and extend horizontally from interior passage 26 to the interior of toilet bowl 10. When vacuum producing device 32 is activated by depressing toilet seat 14, odor-laden air from the interior of toilet bowl 10 will be sucked through front vacuum holes 46 and rear vacuum holes 48 and ultimately be expelled through exhaust tube 34.

In operation, when the toilet seat 14 is depressed, as by being sat upon, time switch 38 is activated causing vacuum producing device 32 to begin operation. Vacuum is produced in internal passage 26 and air drawn from the interior of toilet bowl 10 through the front holes 37 and rear holes 39. In the alternate modification of the device (FIGS. 5 and 6), the odor-laden air is sucked through horizontal front vacuum holes 46 and horizontal rear vacuum holes 48 into internal passage 26. This odor-laden air is transmitted through vacuum ducts 28, flexible hose 30 to vacuum producing device 32 and thus expelled through exhaust tube 34 to the outside. When the toilet user rises from the toilet seat 14, toilet seat 14 will be pressed upward by the time switch 38 and pivot about pivot bar 18. The time switch 38 pushes pushes toilet seat 14 upward so as to pivot on pivot bar 18. Time switch 38, however, remains "on" for about a sixty (60) second period during which time the vacuum producing device 32 continues to draw odor-laden air from the interior of toilet bowl 10. Presumably, the toilet bowl will then be flushed ridding it of wastes. Thus at the end of sixty seconds the time switch 38 will turn off, deactivating the device and readying the invention for further use.

I claim:

1. A ventilating toilet seat comprising in combination:

a toilet bowl;

a water tank positioned adjacent to said toilet bowl;

a toilet seat positioned on said toilet bowl and rotatably hinged thereon, said toilet seat having an interior chamber therein;

ventilation ducts extending from said interior chamber to said toilet bowl, said ventilation ducts comprising openings in forward and rearward portions of said toilet seat; dual vacuum ducts attached to each end of the rear portion of said toilet seat and in communication with each end of the rear portion of said interior chamber; each of said vacuum ducts being integrally formed at the rear portion of said toilet seat and extending upwardly and outwardly from said toilet seat in a direction towards the rear of said toilet bowl and being located outwardly of the toilet seat hinge whereby said toilet seat may be rotated without interference by said dual vacuum ducts; dual flexible hoses attached to each of said dual vacuum ducts; a vacuum producing device attached to said dual flexible hoses, said vacuum producing device comprising a housing positioned beneath said water tank, said housing having an enclosed, arcuate generally U-shaped exhaust chamber having opposed portions and an electric motor centrally positioned in an enclosed housing portion between the legs of said U-shaped exhaust chamber, a pair of cylindrical rotating vanes extending outwardly from said electric motor in opposite direction and are rotated by said electric motor, each of said cylindrical rotating vanes being positioned within and closely fitting one of the legs of said U-shaped exhaust chamber, each of said cylindrical vanes being axially aligned with the other cylindrical vane and said electric motor; dual intake tubes integrally formed on and extending outwardly from the legs of the U-shaped housing of the vacuum producing device, each of said dual intake tubes being axially aligned with said rotating cylindrical vanes and attached to said dual flexible hoses, an exhaust duct integrally formed on and extending outwardly from said housing, said exhaust duct being centrally located between the legs of said U-shaped exhaust chamber and in axially alignment with said electric motor, exhaust tube connected with said exhaust duct and extending therefrom; a time switch positioned within said toilet seat, in contact with said toilet bowl, electrically connected to said vacuum producing device and adapted to activate said vacuum producing device, said time switch being a seat activated time switch with means to remain in the "on" position for a period of time after release of said time switch.

2. The combination as claimed in claim 1 in which said ventilating ducts are comprised of, in combination:

downwardly disposed front ventilating ducts positioned in the forward portion of said toilet seat and extending from said interior chamber to said toilet bowl;

downwardly disposed rear ventilating ducts positioned in the lateral rear of said toilet seat and extending downwardly from said interior chamber to said toilet bowl.

3. The combination as claimed in claim 1 in which said ventilating ducts are comprised of, in combination:

horizontally positioned passages at the forward position of said toilet seat;

pair of horizontally disposed passages laterally positioned at the rear of said toilet seat, extending from said interior chamber to said toilet bowl.

* * * * *